US006435102B1

(12) United States Patent
Malkovsky

(10) Patent No.: US 6,435,102 B1
(45) Date of Patent: Aug. 20, 2002

(54) FRONT SECTION OF A RAILWAY CAR

(76) Inventor: Zdenek Malkovsky, K Bruce 7, 160 00 Praha 6, Czech Republic (CZ)

( * ) Notice: Subject to any disclaimer, the term of this patent is extended or adjusted under 35 U.S.C. 154(b) by 0 days.

(21) Appl. No.: 09/509,406

(22) PCT Filed: Sep. 29, 1998

(86) PCT No.: PCT/EP98/06175

§ 371 (c)(1),
(2), (4) Date: May 2, 2000

(87) PCT Pub. No.: WO99/16652

PCT Pub. Date: Apr. 8, 1999

(30) Foreign Application Priority Data

Sep. 30, 1997 (CZ) ..... 3085-97

(51) Int. Cl.[7] ..... B61D 17/00

(52) U.S. Cl. ..... 105/413; 105/422; 105/238.1; 296/204; 296/203.02; 280/796

(58) Field of Search ..... 105/238.1, 456, 105/413, 422, 396, 419; 296/204, 203.02, 194; 280/795, 796, 797, 798, 799, 800, 789; 180/311

(56) References Cited

U.S. PATENT DOCUMENTS

| | | | | | |
|---|---|---|---|---|---|
| 442,894 | A | * | 12/1890 | Hutchins | 296/194 |
| 1,475,332 | A | * | 11/1923 | Wales | 296/204 |
| 2,289,470 | A | * | 7/1942 | Vincent | 296/204 |
| 3,254,914 | A | * | 6/1966 | Steck | 296/204 |
| 4,798,400 | A | * | 1/1989 | Kosuge | 280/796 |
| 5,579,699 | A | * | 12/1996 | Dannawi et al. | 105/416 |
| 5,954,364 | A | * | 9/1999 | Nechushtan | 280/781 |
| 6,196,135 | B1 | * | 3/2001 | Kashima et al. | 105/392.5 |

FOREIGN PATENT DOCUMENTS

| | | | | |
|---|---|---|---|---|
| BE | 387795 | * | 4/1932 | B61C/17/04 |
| BE | 387795 A | * | 4/1932 | |
| EP | 553582 A1 | * | 3/1993 | B61C/17/04 |

* cited by examiner

*Primary Examiner*—S. Joseph Morano
*Assistant Examiner*—Frantz F. Jules

(57) ABSTRACT

The invention relates to the front section of a railway car comprising a motor transverse beam (2) which is horizontally arranged and vertical to the railway car axis (1). Both front section ends are firmly connected to the longitudinal supports located on the sides of a railway car (1), said supports being parallel to the railway car axis (1). The longitudinal supports (10) extend along the railway car axis (1) as diagonal longitudinal supports (3) from the motor transverse beam (2) toward the buffer elements (4). The longitudinal support ends which are situated opposite the motor transverse beam (2) are firmly connected to said buffer elements (4). A coupling support (6) is arranged in the middle of the motor transverse beam (2). Supports (5) which diagonally extend forward are firmly connected to said coupling support and the buffer elements (4). This results in forming a more compact nose of the inventive front section. The nose can be strengthened above and below by firmly connecting said nose to floor panels (7). The floor panels can have stabilizing reinforcing elements (8). The rear part of the front section extends from the motor transverse beam (2) to a horizontal crossover transverse beam (9) in a direction toward the middle of the car. Both crossover transverse beam ends are firmly connected to the longitudinal supports (10). In addition, horizontally extending floor panels (7) are provided above or below said rear pan and the floor panels can have stabilizing reinforcing elements (8).

2 Claims, 1 Drawing Sheet

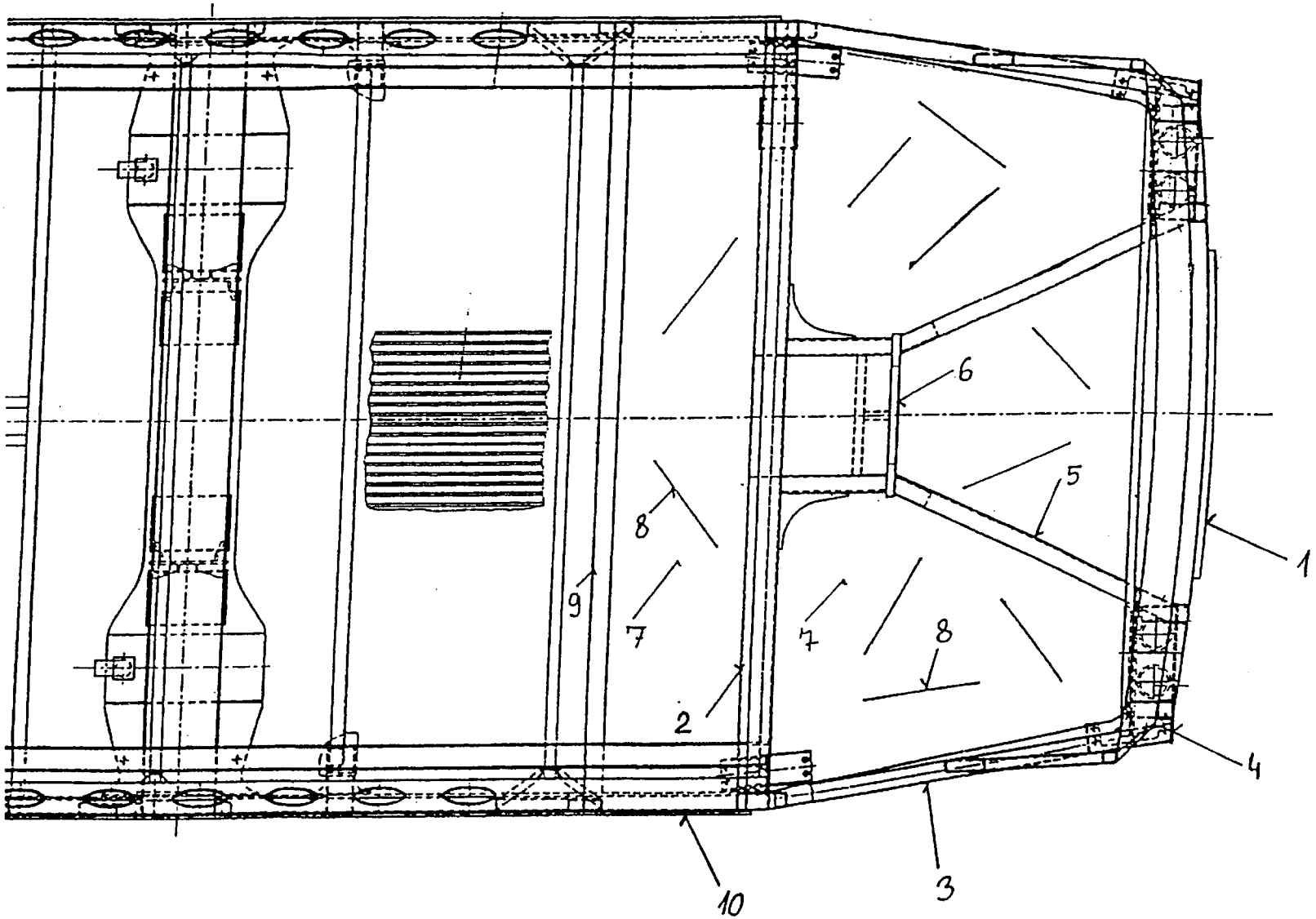
1
4
5
6
8
3
7
10
2
8
7
9

FRONT SECTION OF A RAILWAY CAR

TECHNICAL DOMAIN

The present invention relates to a car body with a front section with longitudinal supports that are arranged so as to be parallel to the longitudinal axis of the car body, a coupling support, and buffer elements. Such front sections ensure the transfer of the longitudinal forces as laid down by the regulations that are in force for the homologation of railway-car bodies, and simultaneously serve as deformation zones in the event of an uncontrolled impact of the car against an obstacle.

PRIOR ART

In the structures known up to now, the longitudinal forces that act on railways cars, which are transferred by the buffers on impact and by the couplings when the car is being pulled, are passed separately to the bodie frames. The rail-car underframes, to which the buffers and the couplings are secured, incorporate different deformation elements, e.g., several types of stiffening, so as to prevent damage being done to the car-body underframe in the event of uncontrolled impact of the car against an obstacle.

One disadvantage in these existing solutions is the complexity of the design that incorporates reinforcing elements, and the associated great mass of the underframe assembly; additional disadvantages are the increased labor cost incurred during the manufacturing process, and finally, increased manufacturing costs.

SUMMARY OF THE INVENTION

The disadvantages referred to above have been eliminated by the car body for railway cars with a front section according to the present invention in that, in order to form the front part of the front section, a motor transverse beam is secured rigidly to the side supports so as to be horizontal and perpendicular to the longitudinal supports that are arranged at the sides of the coach body; in that, starting from the point of attachment towards the buffer elements, the end sections of the longitudinal supports are arranged so as to be diagonal relative to the longitudinal axis of the coach body; and in that the buffer mounting is secured at the mid-point of the motor transverse beam and connected rigidly to the buffer head elements through diagonal supports; and in that in order to form a rear section of the front section, parallel to and spaced back from the motor transverse beam there is a transfer support and this, too, is connected at its ends to the longitudinal supports. Reinforcing plates are installed in the upper and under sides of the front section, in an area of the front part and of and the rear part.

The front part of the front section ensures that longitudinal forces are transferred from the coupling or the buffers directly onto the longitudinal side supports without any additional diagonal or longitudinal stiffening, as was used in earlier solutions when, because of the position of the reinforcement, the functionality of the costly main transverse support of the car body was threatened during an uncontrolled impact, even at low speeds. In the case of the front section according to the present invention, the floor plates are used, and these are protected against any loss of stability by special stabilizing stiffening. The rear or back part of the front section is formed from longitudinal supports, plates, and the transfer transverse support, as a compact, welded element. By changing the arrangement of the stabilizing stiffening and the thickness of the plates that make up this welded element, it is possible to match the design of the front section not only to specific transfer of longitudinal forces, but also to the demands that are imposed for the type of front-section deformation and limiting deformation forces, so that to a certain extent the main transverse supports of the car body and the passenger area are protected against damage in the event of uncontrolled collision or impact. This results in a significant increase in the passive security during operation of a railway car. At the same time, the labor and material costs incurred during production are reduced, as is the overall weight of the car.

BRIEF DESCRIPTION OF THE DRAWINGS

Additional details, features, and advantages of the present invention are set out in the following description of a preferred embodiment, on the basis of the drawings appended hereto, and in the patent claims. The drawing shows a plan view of the construction of the railway car front section according to the present invention.

DETAILED DESCRIPTION

The railway car front section according to the present invention has in its front lower section a motor transverse support 2 that is arranged so as to be horizontal and perpendicular to longitudinal axis of the car body 1. This motor transfer support 2 is secured by its ends to the sides of the car body 1 by longitudinal supports that are rigidly connected to the rear part of the front section so as to be parallel to the longitudinal axis of the car body 1. In the front section, starting from the connection points, the end sections 3 of the longitudinal supports 10 extend diagonally towards the center of the car. A coupling support 6 is mounted at the middle of the motor support 2. Supports 5 extend from the area of the coupling support 6 diagonally forward to the buffer elements 4. Since these parts are also connected rigidly to each other, this results in a compact nose of the front section. Floor plates 7 are installed rigidly on its upper and/or lower side, for example by welding. These can, in turn, be provided with stabilizing reinforcement 8, which can be in the form of sections of profiled steel that are welded in place or in the form of impressed grooves.

The rear part of the front section extends back from the motor transverse support 2 to the center of the car, as far as a transverse support 9, which is also arranged so as to be perpendicular to the longitudinal axis of the car body 1. Both ends of this are secured to the sides of the coach body 1, to the longitudinal supports 10. Floor plating 7 is also secured to the upper and/or lower side of this rear part; this is welded into place. This, too, is provided with stabilizing stiffening 8. The two buffer elements 4 are similarly connected rigidly to each other by way of a longitudinal structural element, this being so configured or incorporating a recess such that the coupling of another car that is to be coupled to the car can be introduced into the space between the supports 5 and the buffer support 6.

When the car is being pulled, the forces that act from the coupling onto the coupling support 6 are transferred through the front section onto the longitudinal supports 10, and thus into the car body as a whole. In the same way, when two cars come into contact with each other, these forces are transferred through from the section onto the longitudinal supports 10 from the head pieces 4 of the buffers, since the kinetic energy of the two car is attenuated by the buffers. In the event of an accident or the uncontrolled impact of a car against an obstacle with enough energy that the force of the impact deforms the lower part of the car, the front section of the car will be sacrificed as a deformation zone. The energy that the front section can absorb by its own deformation can established up to a certain limit by the design, size, and weight, although this may be limited by the dimensions of the car and the position of the stabilizing stiffening 8 that is part of the floor plates 7. After an accident that is not so severe, in which in the underframe of the car body 1 only the forepart of the front section is damaged, all that is required to repair the car is to exchange the damaged front area of the front section, the remaining parts of the underframe of the car body 1 being unaffected.

The supports that are used in the front section according to the present invention are conventional steel Z, U, and T-sections.

The railway car front section according to the present invention can be used to advantage in all new railway cars that are being constructed or re-built since it increases the passive security of the car itself and of its contents, reduces production and servicing costs, and improves its rolling characteristics as a result of lower mass.

What is claimed is:

1. A car body with a front section for railway cars, the front section comprising:

longitudinal supports that are parallel to a longitudinal axis of the car body;

a motor transverse support that is horizontal and perpendicular to the longitudinal axis of the car body and secured to the longitudinal supports;

end sections of the longitudinal supports extending inwardly and diagonally with respect to the longitudinal axis;

a coupling support secured centrally on the motor transverse support;

diagonal supports extending outwardly from the coupling support;

buffer elements rigidly connected to end points of the diagonal supports;

a transition support parallel to and spaced apart from the motor transverse support towards the center of the car and secured rigidly to the longitudinal supports; and reinforcing plates secured to at least one of an upper and a lower side of the front section.

2. A car body as defined in claim 1, wherein the reinforcing plates comprise stiffeners.

* * * * *